US007107639B2

(12) United States Patent
Taricani

(10) Patent No.: US 7,107,639 B2
(45) Date of Patent: Sep. 19, 2006

(54) INFANT SUPPORT APPARATUS

(76) Inventor: Joseph F. Taricani, 46 Sunset Way, San Rafael, CA (US) 94901

( * ) Notice: Subject to any disclaimer, the term of this patent is extended or adjusted under 35 U.S.C. 154(b) by 45 days.

(21) Appl. No.: 10/872,371

(22) Filed: Jun. 22, 2004

(65) Prior Publication Data

US 2005/0278854 A1 Dec. 22, 2005

(51) Int. Cl.
*A47C 16/00* (2006.01)
*A47C 20/02* (2006.01)

(52) U.S. Cl. ..... 5/655; 5/731; 5/904; 5/915; 5/922

(58) Field of Classification Search ..... 5/652, 5/655, 731, 424, 425, 904, 915, 421, 490, 5/482, 655.4, 657, 694, 485, 922, 923, 659, 5/507.1, 420; 248/346.2; 108/43
See application file for complete search history.

(56) References Cited

U.S. PATENT DOCUMENTS 2,654,098 A * 10/1953 Heyward ..... 5/2.1
3,269,621 A * 8/1966 Dishart ..... 224/585
3,271,028 A * 9/1966 Albin ..... 482/142
D211,721 S 7/1968 Radford
3,840,920 A * 10/1974 Voelker ..... 5/702
3,848,278 A * 11/1974 Propst ..... 5/603
4,639,960 A * 2/1987 Quillen et al. ..... 5/710
4,665,573 A * 5/1987 Fiore ..... 5/731
4,790,041 A 12/1988 Shtull
4,862,535 A * 9/1989 Roberts ..... 5/655
D309,068 S 7/1990 Jordan et al.
5,014,376 A 5/1991 Doran et al.
5,029,351 A 7/1991 Weber
5,115,529 A * 5/1992 White ..... 5/655
5,160,185 A * 11/1992 Stang ..... 297/377
5,189,748 A 3/1993 Garrison et al.
5,464,381 A * 11/1995 Wilson ..... 601/49
5,546,620 A * 8/1996 Matthews ..... 5/655
5,572,757 A * 11/1996 O'Sullivan ..... 5/636
5,581,833 A 12/1996 Zenoff
5,600,214 A * 2/1997 Fromson ..... 318/120
5,700,059 A 12/1997 Moscot
5,815,862 A * 10/1998 Rygiel ..... 5/632
5,896,605 A * 4/1999 Branman ..... 5/716
6,038,720 A * 3/2000 Matthews et al. ..... 5/639
6,058,529 A * 5/2000 Goysich ..... 5/94
6,125,487 A 10/2000 Ive
6,128,797 A * 10/2000 Shaffer ..... 5/638
6,189,169 B1 * 2/2001 Marcotte ..... 5/655
6,230,347 B1 * 5/2001 Alexander ..... 5/636
6,370,715 B1 * 4/2002 Morton ..... 5/655
6,381,785 B1 5/2002 Mancera Browne et al.
6,499,164 B1 12/2002 Leach
6,564,408 B1 * 5/2003 Van Vuuren ..... 5/655
6,611,978 B1 * 9/2003 Schmidt et al. ..... 5/603

(Continued)

*Primary Examiner*—Patricia Engle
*Assistant Examiner*—Gilbert Lee
(74) *Attorney, Agent, or Firm*—Catherine F. Lytle

(57) ABSTRACT

An infant support apparatus for supporting an infant lying prone on its torso, configured to aid in soothing the infant and to aid in relieving and reducing the infant's gas pains. The infant support apparatus supports the head of the infant, the torso of the infant, and the legs of the infant such that the infant's head is elevated above its torso and its legs. The infant support apparatus is optionally fire retardant and fire resistant and includes a removable washable cloth cover. Retaining straps are used for holding the infant on the support apparatus. The infant support apparatus is shaped to conform to an underlying surface.

27 Claims, 4 Drawing Sheets

U.S. PATENT DOCUMENTS 6,725,481 B1 * 4/2004 Marshall ..... 5/650
6,785,922 B1 * 9/2004 Bretschger et al. ..... 5/694
6,933,469 B1 * 8/2005 Ellis et al. ..... 219/217
2002/0133881 A1 * 9/2002 Vrbas et al. ..... 5/655
2003/0177582 A1 * 9/2003 Gohl ..... 5/639

* cited by examiner

INFANT SUPPORT APPARATUS

BACKGROUND OF THE INVENTION

1. Field of the Invention

The present invention is related to infant supports and more specifically, infant supports that are constructed to comfortably elevate and support an infant's torso when in a prone position for soothing, and relieving the infant while reducing its gas pains.

2. Discussion of the Background

Caring for an infant with Gastro Esophageal Reflux Disease (GERD), or gas pains can be difficult for both a parent and the infant. The parent has the burden of comforting the infant who appears to be in constant pain. The infant is unable to express clearly the cause of pain or to comfort herself. Typically parents comfort the infant by holding her upright while applying a small amount of pressure to the infant's belly and warming her stomach. This process can take hours, is cumbersome, and is not always effective.

The American Pediatric Association recommends that infants with GERD be held upright with their heads elevated and supported above their torso and legs to reduce the amount of gastric acid entering the esophagus, and to relieve gas pain. This conventional method of keeping an infant in this position requires that the adult hold the infant upright with the infant's head resting on the adult's shoulder.

U.S. Patent Publication 2002/0133881 discloses a baby apparatus for elevating a baby's upper body to strengthen the neck and back muscles, or to relieve congestion. The apparatus is shaped like a ramp, with a single inclined surface. The apparatus operates as an infant exercise device and purposefully does not support the infant's head.

U.S. Pat. No. 5,700,059 discloses a vertical baby support for simulating an ordinary holding position of a baby. The vertical baby support has a single inclined surface to which the baby is strapped and is intended to be used in place of adult contact.

U.S. Pat. No. 6,381,785 discloses an adjustable and releasable holding device for positioning an infant on an inclined platform without the need of a wedge-shaped apparatus. The primary objective of this device is to aid the infant's caregiver in safely laying the infant in an inclined position while sleeping.

These conventional devices do not address the care required for an infant with GERD. The infant with GERD should be soothed by an adult while laying stomach-down on her torso. The infant is usually uncomfortable and so it is beneficial to maintain contact with the adult caregiver during episodes of GERD.

The present invention enables the adult to aid in relieving the infant from the discomfort caused by GERD by holding the infant in the ideal position and enables the adult to maintain contact with the infant by speaking to the infant, reading to the infant, rubbing the infant's back, etc., while reducing the amount of physical stress and fatigue on the adult.

SUMMARY OF THE INVENTION

One object of the present invention is to overcome the difficulties and limitations of conventional approaches for soothing an infant with GERD or gas pains. While this is just one object of the present invention, numerous other features and attributes of the present invention will become evident from the accompanying figures and detailed description of the preferred embodiments.

One feature of the present invention is an infant support apparatus for supporting an infant lying on its torso, stomach-down. The infant support apparatus has a main body having a predetermined width, a predetermined length that extends from a front to a back, a thickness that varies along the predetermined length, and a top surface. In one embodiment the top surface is made up of three contiguous surface portions, which are at sloped angles to each other. A first surface portion is substantially oriented at a first positive slope with respect to a lengthwise direction of the main body. A second surface portion abuts the first surface portion and is substantially oriented at a negative slope with respect to the lengthwise direction of the main body. A third surface portion abuts the second surface portion and is substantially oriented at a second positive slope with respect to the lengthwise direction of the main body. The first surface portion is configured to support a head of the infant, the second surface portion is configured to support a torso of the infant, and the third surface portion is configured to support legs of the infant. A secondary support is included to aid in supporting the main body. The main body and the secondary support are formed as an integral unit.

The above and other objects may be accomplished with a reconfigurable infant support apparatus according to the present invention. In one embodiment, an extension platform protrudes beyond a front edge of the infant support apparatus, allowing the adult to place objects of interest in front of the infant to entertain and educate the infant while she is being soothed.

In one embodiment, the infant support apparatus includes a secondary support that is detachably attached to the main body.

In another embodiment, the infant support apparatus contains a variable heating device to warm the infant's belly and to warm the caregiver's legs.

Another feature of the infant support apparatus is a variable vibrator to soothe the infant and relax the caregiver. Another feature of the infant support apparatus is an audio transducer which can play songs, recorded messages, or the recorded sound of the mother's heartbeat.

Additional features of the infant support apparatus include a restraining strap to keep the infant secure on the infant support apparatus, a retractable guard to reduce the risk of the infant rolling off of the infant support apparatus, pouches, loops, and hook and loop fabric strips to enable easy storage and easy access of toys, rattles, pacifiers, bottles, and other infant paraphernalia.

The present invention enables the caregiver to comfortably hold the infant in an elevated position on the infant's belly. The infant is positioned to reduce discomfort caused by GERD (or simply gas pains) while the infant support apparatus easily conforms to any underlying surface, enabling the caregiver to comfortably hold the infant support apparatus on their lap.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
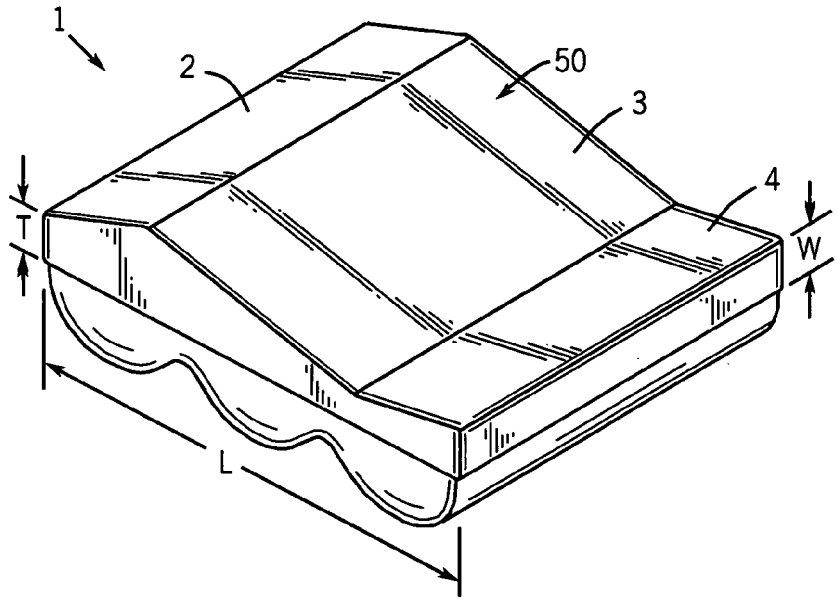
FIG. 1A is a perspective view of an infant support apparatus according to the present invention.

Referring now to the drawings, wherein like reference numerals designate identical or corresponding parts throughout the several views, and more particularly to FIG. 1A, FIG. 1A shows a first embodiment of an infant support apparatus of the present invention. A main body 1 has a predetermined length, L in an inclusive range of eighteen inches to twenty four inches, a width, W in an inclusive range of fourteen inches to eighteen inches, and a thickness, T in an inclusive range of two inches to nine inches along the length direction corresponding to a suitable position for the infant. While specific ranges are given, the invention should not be construed as being restricted to these dimensions. The L, W, and T dimensions may vary according to the infant size. For example, a small size (and thus smaller dimensions) is more appropriate for newborns, while larger sizes are more appropriate for larger infants, or toddlers. Likewise, the main body may be made of materials other than a foam core, and thus could be thinner, if made of a more rigid material.

The main body 1 has a top surface 50 that includes a first surface portion 2 that supports the infant's head, a second surface portion 3 to support the infant's torso, and a third surface portion 4 to support the infant's legs. The first surface portion 2 enables the infant's head to be elevated above the infant's torso and legs. The second surface portion 3 enables the infant to rest on her torso in an elevated position, creating enough pressure so gas can escape and gravity will reduce the amount of gastric acids escaping from the infant's gastrointestinal tract.

Figure 1B:
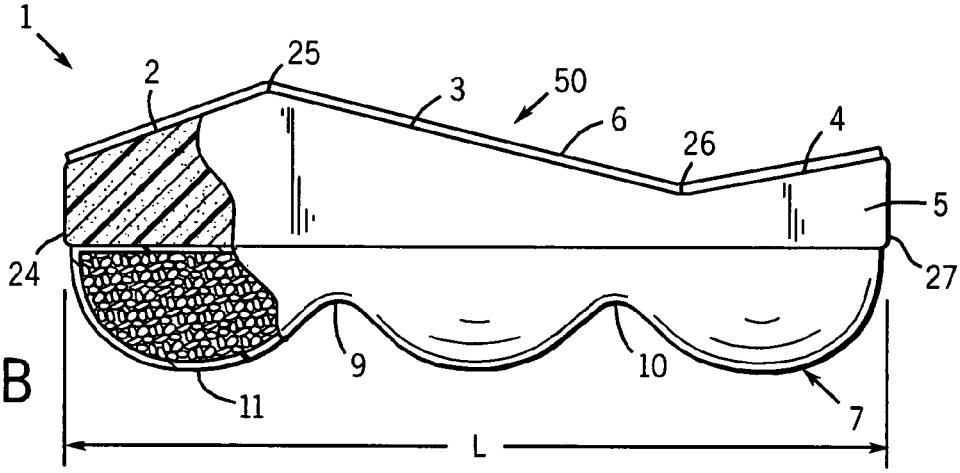
FIG. 1B is a profile view of an infant support apparatus according to the present invention.

FIG. 1B shows a profile view of an infant support apparatus of the present invention. The main body 1 is made of a molded foam core 5. However, the material could also be made from a molded plastic core, a molded Plexiglas core, or other material that is able to support twenty pounds, or so, while still soft enough to lay an infant on. The molded foam core 5 is thickest under the first surface portion 2 at the location where the first surface portion 2 is connected to the second surface portion 3. The second surface portion 3 has a descending (or negative) slope on which the infant's torso rests, and the third surface portion 4 is at a slight incline (positive slope) for the infant to rest her legs thereupon.

In one non-limiting example, the thickness of the infant support apparatus at a front edge 24 is at least one inch, the thickness of the infant support apparatus at a first inflection point 25 is at least three inches, the thickness of the infant support apparatus at a second inflection point 26 is at least one inch, the thickness of the infant support apparatus at a back edge 27 is at least two inches, but other thicknesses can be used as well, depending on the size of the infant. The first inflection point 25 is located where a width-wise edge of the first surface portion 2 and where a width-wide edge of the second surface portion 3 coincide, and the second inflection point 26 is located where another width-wide edge of the second surface portion 3 and a width-wide edge of the third surface portion 4 coincide.

In this example, the length of first surface portion 2 is twenty five percent of the predetermined length L of the infant support apparatus, the length of the second surface portion 3 is fifty percent of the predetermined length L of the infant support apparatus, and the length of the third surface 4 portion is twenty five percent of the predetermined length of the infant support apparatus, but various lengths can be utilized, depending on the size of the infant.

The molded foam core 5 is preferably made from a fire-retardant material and is covered with a non-toxic and water resistant coating.

Optionally, a cloth cover 6 is adapted to fit over the top surface 50, or over the entire infant support apparatus 1. The cloth cover 6 is detachably attached, washable, and made from non-toxic fire-retardant materials. A topside of the cloth cover 6 is preferably made from a cotton fabric, but could also be made from a terry cloth fabric, or other infant-friendly material. An underside of the cloth cover 6 is preferably made from a non-skid, water repellant, non-toxic material. The non-skid material will enable the cloth cover 6 to remain in place over the molded foam core 5 while the infant rests upon the top surface 50. The cloth cover 6 can be removed from the top surface 50 for washing and also used as a changing pad.

A secondary support 7 has a bottom 11 which easily conforms to any underlying surface. The bottom 11 includes a fabric (plastic or other suitable) bag or container containing a plurality of small pieces of material, where this plurality of small pieces of material can move independently of each other, conforming to various shapes. In one example, the bottom of the secondary support 7 is made of a bean-bag (filled with any type of suitable material such as polystyrene pieces). The secondary support 7 contains a valley portion 9 and another valley portion 10 that are configured to substantially conform to the legs of a person's lap. The secondary support 7 is permanently attached to the main body 1, so that the main body 1 and the secondary support 7 are formed as an integral unit.

Figure 1C:
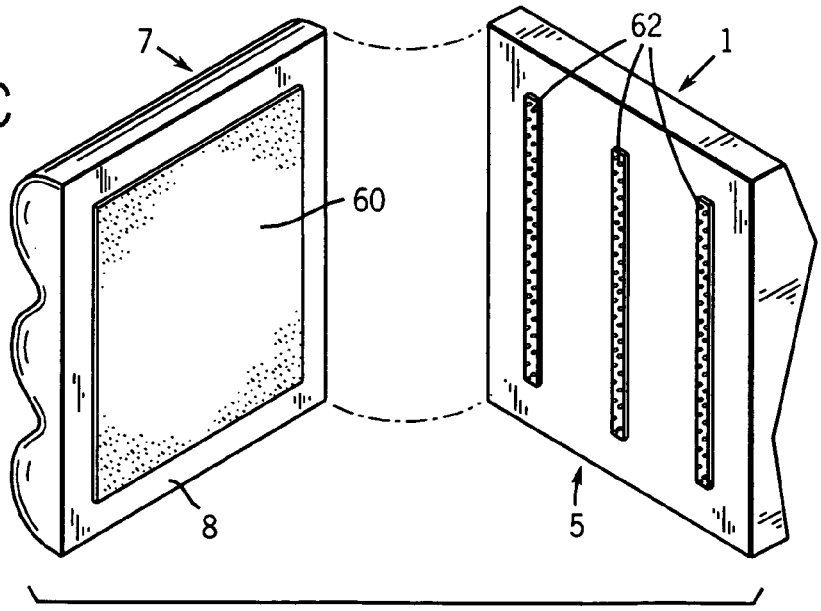
FIG. 1C is an exploded view of an infant support apparatus according to the present invention with an optional feature including a detachably attached secondary support attachment to a main body.

FIG. 1C shows an exploded view of another embodiment of an infant support apparatus of the present invention wherein the secondary support 7 is detachably attached to the main body 1. An underside of the main body 1 is displayed and a topside of the secondary support is displayed. The secondary support 7 is made of a rigid material with a top surface 8 that is generally planar. The secondary support 7 aids in supporting the main body 1 and in facilitating a caregiver in holding the infant support apparatus. The secondary support 7 is detachably attached to a bottom of the main body 1 using hook fabric 60 and loop fabric strips 62. Alternatively snaps, or nothing (simply gravity and friction) is used.

Figure 2:
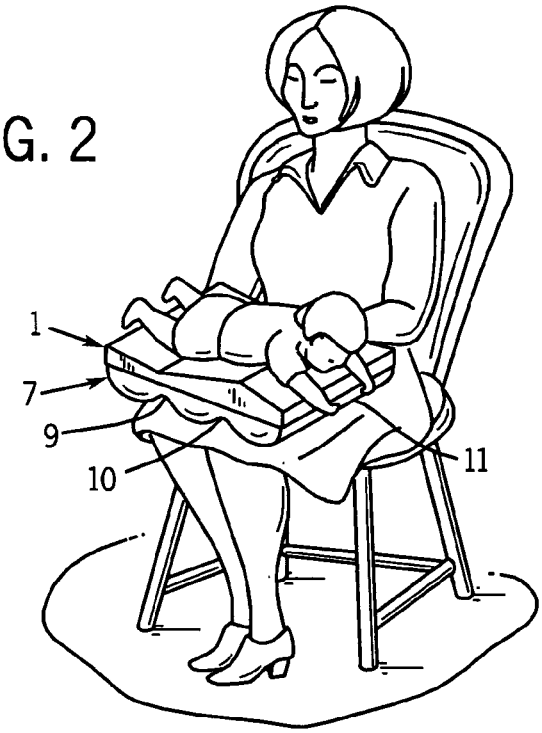
FIG. 2 is a perspective view of the infant support apparatus according to the present invention being held by an adult with an infant lying on its belly.

FIG. 2 shows an adult holding the infant support apparatus while an infant is lying prone on its torso resting thereupon. The valley portion 9 and another valley portion 10 of the secondary support 7 bottom surface conform to a right leg of the adult and a left leg of the adult respectively.

Figure 3:
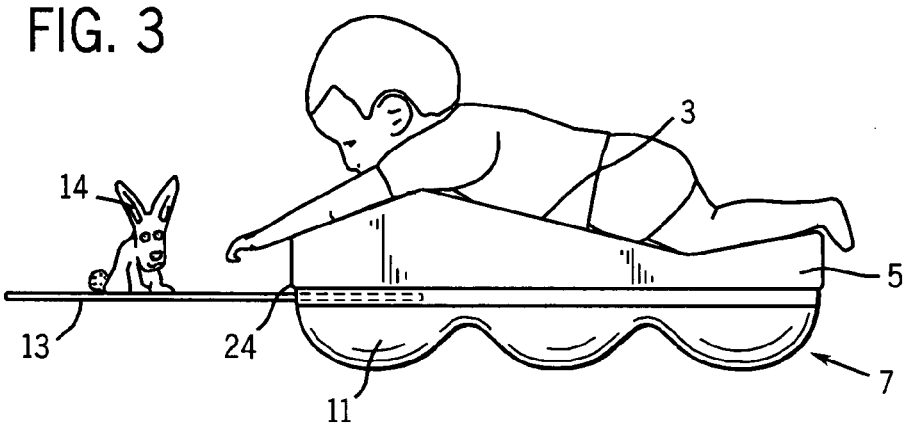
FIG. 3 is a profile view of an infant support apparatus of the present invention with a platform extending beyond a front edge of the infant support apparatus.

FIG. 3 shows another embodiment of the present invention wherein an extension platform 13 protrudes beyond the front edge 24 of the infant support apparatus. The extension platform 13 can support objects for the infant to look at while resting in the infant support apparatus. Such objects can include a toy 14, books, or other interesting or educational visual stimulants. Alternatively, a baby monitor or a wireless camera may be mounted on the extension platform 13 so the caregiver can monitor the infant's activities from a remote location. The extension platform 13 may also be used as a resting place for objects of interest for the adult (e.g., reading glasses, remote control, etc.). The extension platform 13 may be extended (shown) or retracted from the secondary support 7. Alternatively, the extension platform 13 may be detachably attached to the secondary support 7 by securely installing at least one screw (or other suitable fastener) through a bottom edge of the extension platform 13 into a bottom of a side of the molded foam core 5. Alternatively, the bottom edge of the extension platform 13 includes at least one spring loaded clasp at one end of the extension platform 13 which mates into at least one receiving clasp into the bottom side of the molded foam core 5.

Figure 4:
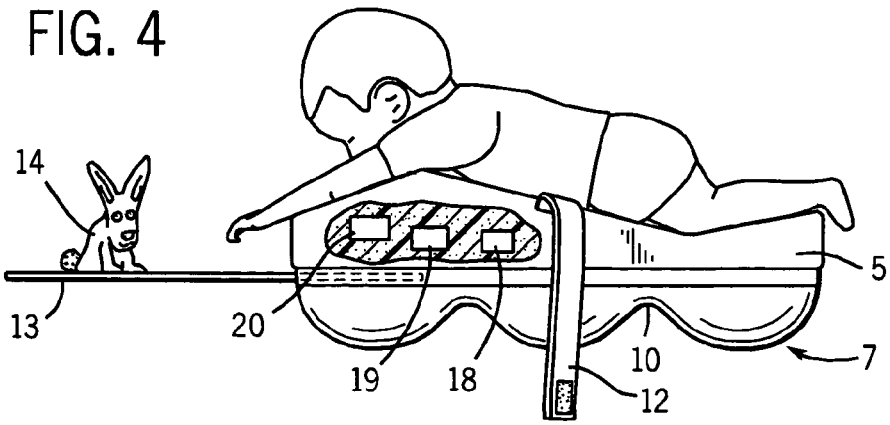
FIG. 4 is a profile view of an infant support apparatus of the present invention with optional features, including a restraining strap, a variable heating mechanism, a variable vibrating mechanism, and an audio transducer.

FIG. 4 shows additional optional features of the present invention wherein a restraining strap 12 is used to ensure the infant will remain on the infant support apparatus should the adult become distracted. A battery powered or 115 VAC adapted variable heating mechanism 18 is optionally inserted into a cavity of the molded foam core 5 and can be used to keep the infant's stomach warm, increasing the likelihood of soothing the infant. A battery powered or 115 VAC adapted variable vibrating mechanism 19 is optionally inserted into the molded foam core 5 and can be used to aid in the release of bodily gas. The variable heating mechanism 18 and the variable vibrating mechanism 19 also have the added benefit of providing a therapeutic massage to the caregiver while holding the infant and may alleviate leg cramps in the caregiver.

A battery powered or 115 VAC adapted audio transducer 20 is optionally inserted in the molded foam core 5 and is used to soothe the infant by playing pre-recorded songs, messages, or the mother's recorded heartbeat. The audio transducer 20 may use an audio tape, or optionally MP3 files loaded via an I/O port such as a USB port. A control to adjust the temperature of the variable heating mechanism 18 is located on the periphery of the molded foam core 5. A control to adjust the intensity of vibration for the variable vibrating mechanism 19 is located on the periphery of the molded foam core 5. A control to adjust the volume for the audible transducer 20 is located on an outer periphery of the molded foam core.

Figure 5A:
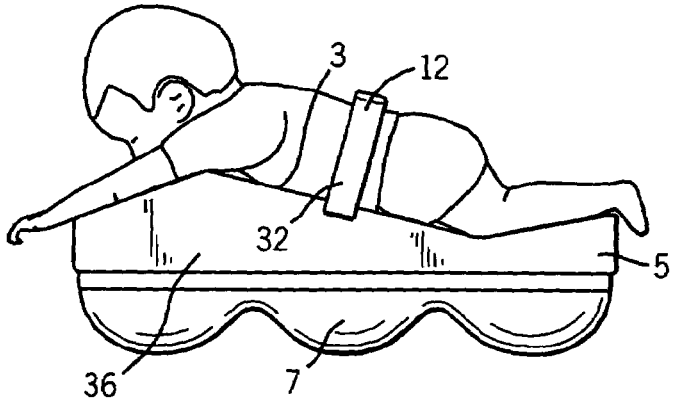
FIG. 5A is a profile view of the infant support apparatus of FIG. 4 with an infant being restrained by the restraining strap.

FIG. 5A shows a peripheral view of the present embodiment wherein the infant is held in place by at least one restraining strap 12 attached to a side 36 of the second surface portion 3. The restraining strap 12 is made from cloth webbing, or an elastic band, although other material may be used as well.

Figure 5B:
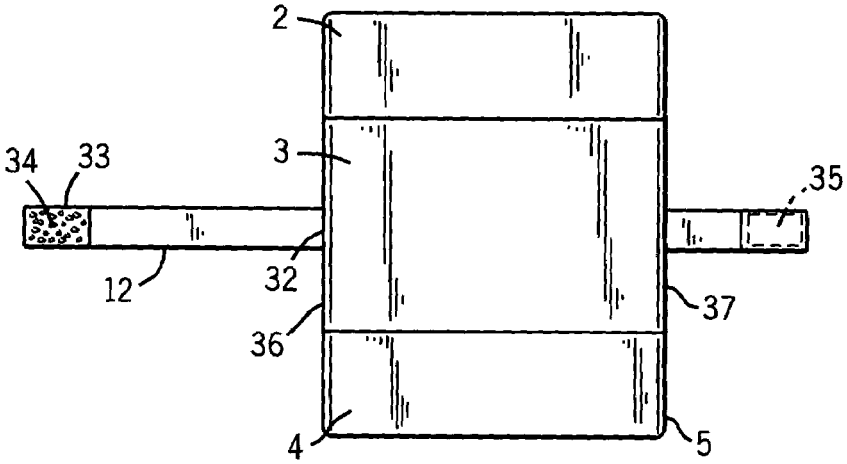
FIG. 5B is a top view of the infant support apparatus of FIG. 4 with the restraining strap.

FIG. 5B shows a top view of the infant support apparatus shown in FIG. 5A of the present invention, although without the infant. The restraining strap 12 has a fixed end 32 and an exposed end 33. The fixed end 32 of the restraining strap 12 is adhered to a side 36 of the second surface portion 3 by sewing the fixed end 32 of the restraining strap 12 into the molded foam core 5. Alternatively, the fixed end 32 of the restraining strap 12 could be adhered (e.g., with an adhesive) to an underside of the molded foam core 5. The exposed end 33 of the restraining strap has a loop fastening strip 34. Another side 37 of the second surface portion 3 is a mating hook fastening strip 35. Alternatively, the exposed end 33 of the restraining strap 12 has a female clasp end, and another side 37 of the second surface portion 3 has a male clasp end that receives the female clasp end.

Figure 5C:
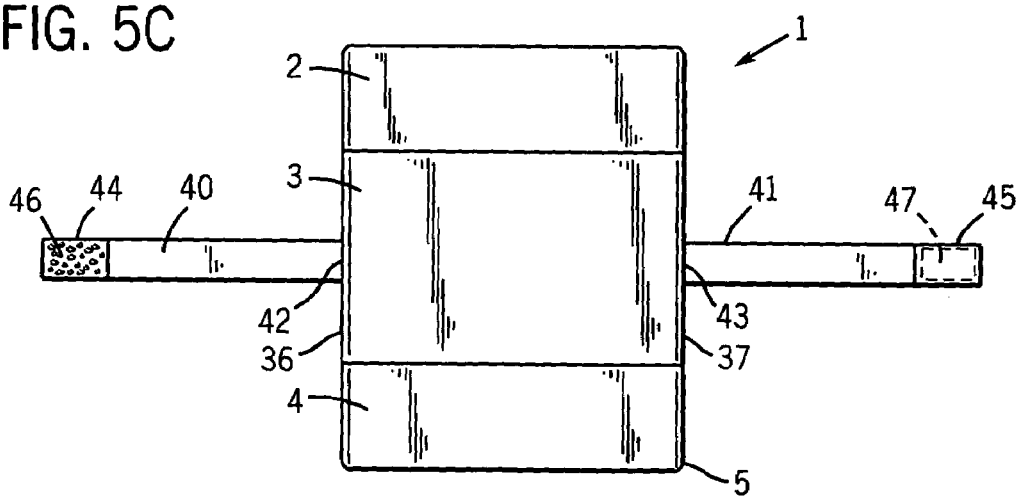
FIG. 5C is a top view of the infant support apparatus of FIG. 4 with at least one restraining strap.

FIG. 5C is an overhead view of at least one restraining strap 12 attached to the second surface portion. A first restraining strap 40 has a fixed end 42 and an exposed end 44. A second restraining strap 41 has a fixed end 43 and an exposed end 45.

The fixed end 42 of the first restraining strap 40 is sewn into a side 36 of the second surface portion 3. Alternatively, the fixed end 42 of the first restraining strap 40 could be fixed to an underside of the molded foam core 5.

The fixed end 43 of the second restraining strap 41 is sewn into another side 37 of the second surface portion 3. Alternatively, the fixed end 43 of the second restraining strap 41 could be fixed to an underside of the molded foam core 5.

The first exposed end 44 has a loop fastening strip 46 and a second exposed end 45 has a mating hook fastening strip 47. Alternatively, the first exposed end 44 has a female clasp end, and the second exposed end 45 has a male clasp end that receives the female clasp end.

Figure 6A:
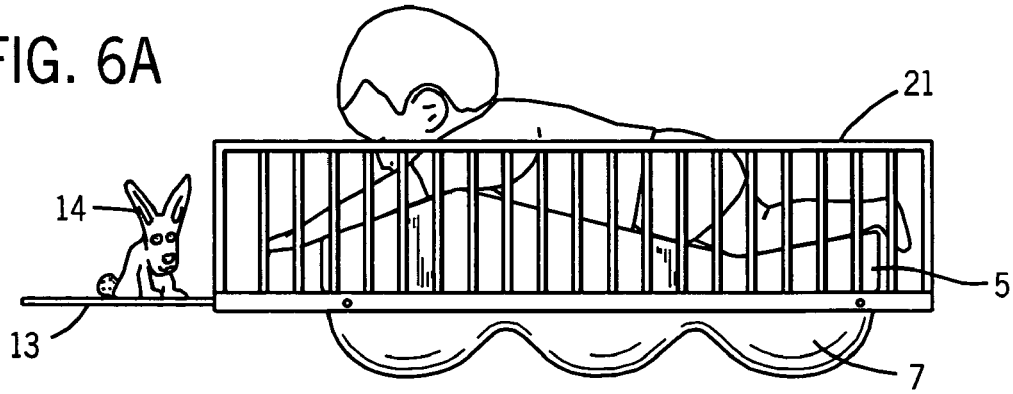
FIG. 6A is a profile view of another embodiment of the infant support apparatus of the present invention with a retractable guard.

FIG. 6A shows another embodiment of the present invention wherein a retractable guard 21 has been erected to ensure the safety of the infant should the caregiver need to leave the infant unattended momentarily. A bottom edge of the retractable guard has at least one spring loaded clasp which mates into at least one receiving clasp into a bottom edge of the molded foam core 5. Alternatively, the bottom edge of the retractable guard 21 is detachably attached to the bottom edge of the molded foam core 5 by securely installing at least one screw through the bottom edge of the retractable guard 21 into a plate adhered to the bottom edge of the molded foam core 5. The retractable guard 21 is configured as a wooden gate, although wire mesh or netting may be used as well.

Figure 6B:
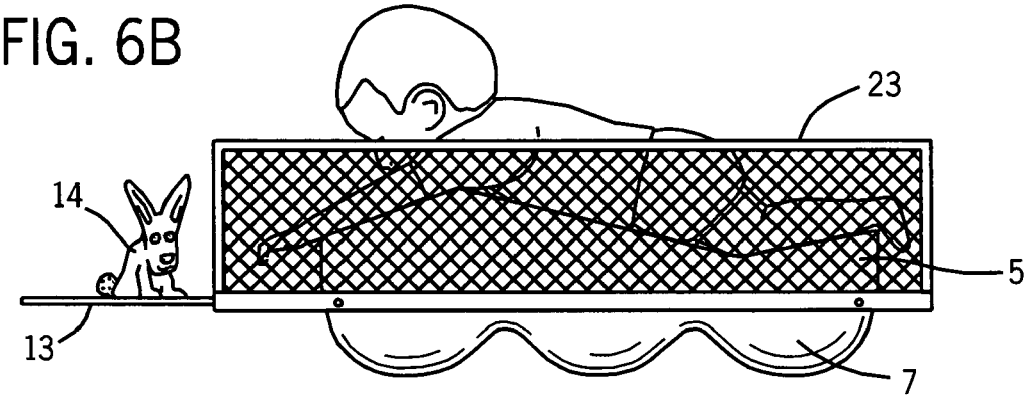
FIG. 6B is a profile view of an infant support apparatus according to the present invention with a retractable mesh guard.

FIG. 6B shows another embodiment of the present invention wherein a retractable guard 23 has been erected to ensure the safety of the infant should the caregiver need to leave the infant unattended momentarily. A bottom edge of the retractable guard has at least one spring loaded clasp which mates into at least one receiving clasp into a bottom edge of the molded foam core 5. Alternatively, the bottom edge of the retractable guard 23 is detachably attached to the bottom edge of the molded foam core 5 by securely installing at least one screw through the bottom edge of the retractable guard 23 into a plate adhered to the bottom edge of the molded foam core 5. The retractable guard 23 is configured as a mesh gate 23.

Figure 7A:
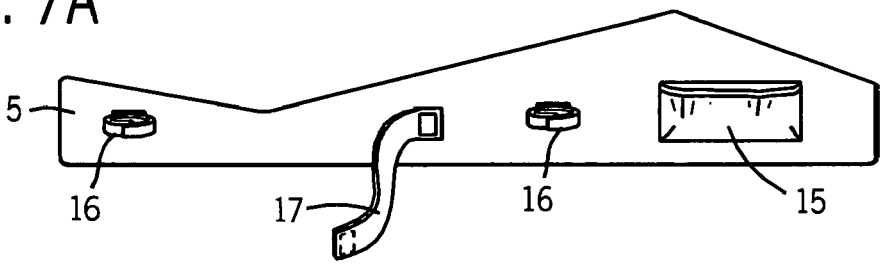
FIG. 7A is a profile view of a first side of the infant support apparatus embodiment of the present invention with a side pouch, hook and loop fabric strips, and fabric loops.

FIG. 7A shows another embodiment of the present invention wherein various baby paraphernalia can be conveniently stored and located. A pouch 15 located on a side of the molded foam core 5 can be used to store wipes, bibs and the like, at least one fabric loop 16 attached to a side of the molded foam core 5 can be used to secure pacifiers, rattles, keys, at least one hook and loop fabric strip 17 located on a side of the molded foam core 5 can be used to attach toys, bibs, and the like.

Figure 7B:
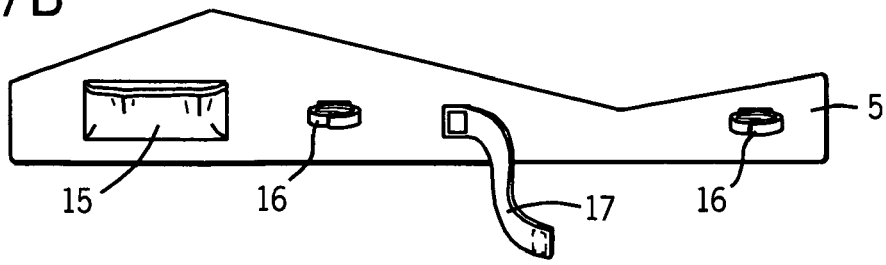
FIG. 7B is a profile view of an opposite side of the infant support apparatus embodiment of the present invention with a side pouch, hook and loop fabric strips, and fabric loops.

FIG. 7B shows an opposite side to that shown in FIG. 7A.

While various features and embodiments have been shown, it should be clear that features in one embodiment may be substituted (or deleted) for features in another embodiment.

I claim:

1. An infant support apparatus for supporting an infant lying stomach-down, comprising:

a main body having a predetermined width, a predetermined length that extends from a front to a back, and a thickness that varies along said predetermined length, said main body having a top surface that includes a first substantially planar surface portion substantially oriented at a first positive slope with respect to a lengthwise direction of said main body from said front to said back, a second substantially planar surface portion substantially oriented at a negative slope with respect to the lengthwise direction of said main body, and a third substantially planar surface portion substantially oriented at a second positive slope with respect to the lengthwise direction of said main body, wherein said first substantially planar surface portion, said second substantially planar surface portion and said third substantially planar surface portion being positioned in order from said front to said back such that said first surface portion being arranged to support a head of said infant, and said second surface portion being positioned to support at least a torso of said infant, and said third surface portion being positioned to support legs of said infant, an average thickness of said main body under said first substantially planar surface portion being greater than that for said third substantially planar surface portion, a length of said second substantially planar surface portion being greater than a length of said first substantially planar surface portion, and a length of said third substantially planar surface portion.

2. The infant support apparatus of claim 1, wherein said main body comprising a molded foam core.

3. The main body of claim 2, wherein:

said main body is made of at least one of a fire-resistant material and a fire retardant material.

4. The infant support apparatus of claim 2, further comprising:

at least one fabric loop on said molded foam core to detachably attach infant toys.

5. The infant support apparatus of claim 2, further comprising:

at least one hook and loop fabric strip on said molded foam core to detachably attach an infant toy.

6. The infant support apparatus of claim 2, further comprising:

a retractable guard configured to extend above said top surface on one side of said molded foam core.

7. The infant support apparatus of claim 6, wherein:

said retractable guard being at least one of a mesh guard and a fence guard.

8. The infant support apparatus of claim 1, further comprising:

a detatchably attached cloth cover adapted to fit over said top surface.

9. The detatchably attached cloth cover of claim 8, wherein:

said detatchably attached cloth cover is at least one of a man-made washable material and a fire retardant material.

10. The infant support apparatus of claim 8, wherein:

said detatchably attached cloth cover has a water-resistant layer so as to make said detachably attached cloth cover suitable for use as a changing pad.

11. The infant support apparatus of claim 1, further comprising:

a secondary support disposed on a bottom of said main body, said secondary support including a material more rigid than that of the main body, and having a top surface that is substantially planar.

12. The infant support apparatus of claim 11, wherein said secondary support is shaped to conform to a person's lap when holding the infant support thereon.

13. The infant support apparatus of claim 12, wherein a shape of a bottom surface of said secondary support contains a valley portion that is configured to substantially conform to an upper portion of a leg of said person's lap.

14. The infant support apparatus of claim 13, wherein the shape of the bottom surface of said secondary support contains another valley portion that is configured to substantially conform to another leg of said person's lap.

15. The infant support apparatus of claim 12, wherein said secondary support includes a bag containing a plurality of pieces of material.

16. The infant support apparatus of claim 15, wherein said bag being a bean bag.

17. The infant support apparatus of claim 11, wherein a shape of said secondary support is configured to conform to an underlying surface.

18. The infant support apparatus of claim 17, wherein a bottom portion of said secondary support includes a bag containing a plurality of pieces of material.

19. The infant support apparatus of claim 18, wherein said bag being a bean bag.

20. The infant support apparatus of claim 11, further comprising:

an extension platform that protrudes beyond a front edge of said main body.

21. The infant support apparatus of claim 20, wherein:

said extension platform includes a rigid material able to support at least a one pound object.

22. The infant support apparatus of claim 11, wherein:

said secondary support is detachably attached to said main body.

23. The infant support of apparatus claim 1, wherein:

said second substantially planar surface portion comprising at least one restraining strap configured to hold said infant.

24. The infant support apparatus of claim 1, further comprising:

at least one pouch on said main body.

25. The infant support apparatus of claim 1, further comprising:

a variable heating mechanism.

26. The infant support apparatus of claim 1, further comprising:

a variable vibrating mechanism.

27. The infant support apparatus of claim 1, further comprising:

an audio transducer.

* * * * *